US008411533B2

(12) United States Patent
Mieville et al.

(10) Patent No.: US 8,411,533 B2
(45) Date of Patent: Apr. 2, 2013

(54) CRYSTAL-BEZEL ASSEMBLY UNIT FOR A TIMEPIECE AND PROCESS ASSEMBLY

(75) Inventors: Jacques Mieville, Cuarnens (CH); Jérôme Favre, Les Bioux (CH); Sylvain Marechal, Bois-d'Amont (FR); Simon Lauper, Le Solliat (CH)

(73) Assignee: Montres Breguet S.A., L'Abbaye (CH)

( * ) Notice: Subject to any disclaimer, the term of this patent is extended or adjusted under 35 U.S.C. 154(b) by 198 days.

(21) Appl. No.: 13/049,192

(22) Filed: Mar. 16, 2011

(65) Prior Publication Data

US 2011/0228648 A1 Sep. 22, 2011

(30) Foreign Application Priority Data

Mar. 16, 2010 (EP) ..... 10156622

(51) Int. Cl.
*G04B 39/00* (2006.01)
*G04B 29/00* (2006.01)

(52) U.S. Cl. ..... 368/244; 368/296

(58) Field of Classification Search ..... 368/243–244, 368/294–296
See application file for complete search history.

(56) References Cited

U.S. PATENT DOCUMENTS

| | | | | |
|---|---|---|---|---|
| 3,386,239 | A * | 6/1968 | Shiffman | 368/296 |
| 3,505,807 | A * | 4/1970 | Piquerez | 368/291 |
| 3,733,804 | A | 5/1973 | Diersbock | |
| 4,115,994 | A | 9/1978 | Tomlinson | |
| 4,271,498 | A | 6/1981 | Zafferi et al. | |
| 4,473,306 | A * | 9/1984 | Lederrey | 368/296 |
| 5,604,718 | A | 2/1997 | Mignot et al. | |
| 5,867,452 | A * | 2/1999 | Braun et al. | 368/72 |
| 7,545,706 | B2 | 6/2009 | Candaux | |
| 2008/0165630 | A1 | 7/2008 | Candaux | |

FOREIGN PATENT DOCUMENTS

| | | |
|---|---|---|
| CH | 8252/66 | 10/1971 |
| CH | 626 494 | 11/1981 |
| CH | 626 497 | 11/1981 |
| CH | 698 533 | 8/2009 |
| CH | 698 742 | 10/2009 |

(Continued)

OTHER PUBLICATIONS

Search Report issued in international application No. PCT/EP2011/053878, completed Apr. 6, 2011 and mailed Apr. 12, 2011.

(Continued)

*Primary Examiner* — Sean Kayes
(74) *Attorney, Agent, or Firm* — Griffin & Szipl, P.C.

(57) ABSTRACT

The invention relates to a process for assembly of a crystal and a bezel for use of the crystal as vibrating and radiating element, according to which unconnected junction zones are determined and form the only mechanical link for transmission of vibrations of the bezel to the crystal, on which zones the crystal is secured on the bezel to transmit to the crystal any vibration communicated to the bezel. Outside these zones the crystal is held without direct contact with the bezel.

The invention also relates to a crystal-bezel assembly unit for a timepiece comprising junction zones that form the only mechanical link for transmission of vibrations from the bezel to the crystal to cause the crystal to resonate under the action of the vibrations, and outside said junction zones the crystal has no direct contact with the bezel.

The invention also relates to a timepiece comprising such a unit.

15 Claims, 8 Drawing Sheets

FOREIGN PATENT DOCUMENTS

| | | |
|---|---|---|
| DE | 198 23 981 | 12/1999 |
| EP | 0 694 824 | 1/1996 |
| FR | 2 154 704 | 5/1973 |
| JP | 9-10183 | 1/1997 |

OTHER PUBLICATIONS

Search Report issued in European application 10156622, completed Sep. 6, 2010.

* cited by examiner

CRYSTAL-BEZEL ASSEMBLY UNIT FOR A TIMEPIECE AND PROCESS ASSEMBLY

This application claims priority from European Patent Application No. 10156622.2 filed Mar. 16, 2010, the entire disclosure of which is incorporated herein by reference.

FIELD OF THE INVENTION

The invention relates to a process for assembly between a crystal, on the one hand, and on the other hand, a bezel comprising a notch for accommodating said crystal, for use in a striking or musical timepiece of said crystal as vibrating element radiating the diffusion of an acoustic signal emitted from a vibration source, or a striking train, or a musical box, or an alarm clock, and transmitted to said bezel.

The invention also relates to a crystal-bezel assembly unit for a striking or musical timepiece having at least one vibration source or a striking train, or a musical box, or an alarm clock arranged for use of a crystal as vibrating element radiating the diffusion of an acoustic signal emitted from said vibration source, wherein said crystal-bezel unit comprises a bezel, on the one hand, that transmits the vibrations emitted from said vibration source and comprises a notch for accommodating a crystal and, on the other hand, such a crystal comprising an upper surface and a lower surface connected by an edge.

The invention also relates to a timepiece comprising at least one such crystal-bezel unit.

The invention relates to the field of timepieces comprising means for emitting an acoustic signal such as a striking train, musical box or similar. More particularly, it relates to timepieces that can be worn by the user such as watches, pendants and similar.

BACKGROUND OF THE INVENTION

In fact, the invention proposes to resolve the problem of improving the diffusion of sound through a small-sized timepiece. In fact, while the diffusion of sound is a simple matter in the case of pendulum clocks or clocks that have resonance spaces or cases of large dimensions designed to diffuse sound, it still poses a problem in the case of small-sized timepieces where the space for forming a resonant box or cavity is necessarily very limited and where numerous components impede the proper diffusion of the sound by damping it instead of amplifying it. This problem is all the more difficult since the sound sources provided in the form of bells, gongs or even keypads are themselves very small in size and since the level of sound amplification must be significant for the sound to be audible by the user and possibly the people around him. The amplification and diffusion of sound must not impair its purity and therefore it is vital to prevent any untimely resonance of another component of the timepiece.

Various attempts have been made to create resonant cavities that are generally operated from the user side, such as in the patent document JP 9 010 183 in the name of Seiko Epson, for example. However, the user himself assists in damping the vibration and the efficiency is quite limited because of this.

Tests aiming at using the crystal as vibrating element have long given mixed results. Patent application CH 8252 66 in the name of Spadini describes a flexible crystal rigidly mounted on the bezel and because it is made from an organic synthetic glass, the sound quality is generally greatly degraded because of the heterogeneity of the material.

Patent application FR 2 154 704 in the name of Timex describes an alarm watch with a piezoelectric oscillator that causes the watch crystal to resonate and is fastened directly thereto substantially perpendicular to the tangential plane of the crystal that is secured to the middle by a flexible ring of rubber or similar. This flexible arrangement absorbs too much energy to achieve the desired result. A vibration along the tangent plane to the crystal is only obtained with an oscillator generating vibrations in this direction.

The attachment of a crystal is known from document DE 198 23 981 in the name of Glassen, which describes a watch with a detachable crystal and an invisible edge clipped at its periphery onto a bezel. However, this is not provided for a striking or musical watch and is not designed for the diffusion of sound.

U.S. Pat. No. 4,115,994 describes a watch having a light source and a crystal arranged to diffuse the light in an optimum manner in association with reflection means at the dial.

Patent CH 626 497 in the name of Ebauches has broken new ground by enabling the crystal to be used as vibrating element to serve as vibration transmitter by interposing between the bezel and the crystal a thin annular connecting piece that absorbs little energy and does not impair the sound. These arrangements have been taken up by the patent EP 0 694 824 in the name of Asulab and by patent CH 698 742 in the name of Richemont, in which the annular piece assumes a profile of a dotted line. These solutions have the advantage of not deforming the sound and not significantly damping the vibrations, but the vibration amplitude of the crystal remains limited because of the peripheral hold thereof.

A patent CH 698 533 in the name of Richemont is also known that has sought a better transmission of sounds by attaching bells of a striking train directly to a crystal support welded thereto. Good transmission of the sound is assured, but the positioning of the bells is very specific, being under the crystal, and cannot be applied to all timepieces.

SUMMARY OF THE INVENTION

The invention proposes to provide a new solution to the problem of sound transmission by improving the use of the crystal as vibrating and radiating element with respect to the expected sound quality on the basis of an improved transmission of the vibrations from the mechanism emitting the acoustic signal of the timepiece as far as the crystal via the bezel with the most reduced damping possible and with a substantial increase in the sound level, irrespective of the embedded positioning of the mechanism emitting the signal in the timepiece.

The invention endeavors to provide this crystal with at least a free motion along an axis of free motion, in particular by pivoting, in order to allow a high vibration amplitude of this crystal under the action of a vibration source of a timepiece that is not limited by the assembly of the crystal on the bezel of the timepiece, more particularly a watch.

In particular, the invention allows vibrations of the crystal not only perpendicularly to its surface, as is known in the prior art, but above all along the surface, in which this crystal extends, substantially radially in relation to a normal to the profile of the crystal in its centre.

According to the invention the transmission of vibration from the bezel to the crystal occurs only across certain predetermined contact zones.

On this basis, the invention relates to a process for assembly between a crystal, on the one hand, and on the other hand, a bezel comprising a notch for accommodating said crystal, for use in a striking or musical timepiece of said crystal as vibrating element radiating the diffusion of an acoustic signal emitted from a vibration source, or a striking train, or a musical box, or an alarm clock, and transmitted to said bezel, characterised in that:

an appropriate number of unconnected junction zones intended to form together the only direct mechanical link for the transmission of vibration from said bezel to said crystal, outside which junction zones said crystal has no direct contact with said bezel, is determined, an alternating sequence is created, of on one hand said junction zones is created to support and rigidly secure the crystal in direct contact with said bezel, and on other hand sealing zones where said crystal has no direct contact with said bezel;

said crystal is secured onto said bezel by supporting and clamping at each junction zone on a junction surface of the bezel in order to transmit to said crystal every vibration communicated to said bezel;

in a peripheral space outside said junction zone or zones, said peripheral space being formed from a succession of sealing zones alternating with said junction zones, in which sealing zones the crystal can vibrate in-plane, and each of said sealing zones is delimited by said crystal and one said sealing surface, said crystal is kept at a distance from said bezel to allow vibrations of said crystal there without impeding them.

According to a feature of the invention, to determine said appropriate number of said junction zones:

the natural frequencies of the vibration sources of said acoustic signal such as bells, gongs, keypads or similar are determined, and a pass band corresponding to said natural frequencies is determined;

the peripheral positioning around said crystal is simulated by calculation as a function of the characteristics of said crystal of an appropriate number of said unconnected junction points to adjust the natural vibration frequency and the harmonics of said crystal depending on the thickness of said crystal to make them consistent with the pass band corresponding to said natural frequencies of said vibration sources and to the pass band of the human ear;

the thickness of said crystal and the contact surface between said crystal and said bezel at said junction zone are selected in order to make said natural frequencies and harmonics of said crystal consistent with said pass bands on the basis of the previous calculation and to obtain said appropriate number of junction zones closest to the value two.

According to a feature of the invention, said appropriate number of said junction zones selected is equal to two. Preferably the number of junction zones is two and only two.

According to another feature of the invention, the space contained between said crystal and said bezel is sealed with sealing means.

According to a further feature of the invention, said sealing means having at least one flexible sealing strip and/or at least one elastic membrane are selected.

The invention additionally relates to a crystal-bezel assembly unit for a striking or musical timepiece having at least one vibration source or a striking train, or a musical box, or an alarm clock arranged for use of a crystal as vibrating element radiating the diffusion of an acoustic signal emitted from said vibration source, wherein said crystal-bezel unit comprises a bezel, on the one hand, that transmits the vibrations emitted from said vibration source and comprises a notch for accommodating a crystal and, on the other hand, such a crystal comprising an upper surface and a lower surface connected by an edge, characterised in that it comprises one or more junction zones between said bezel and said crystal that together form a mechanical connection for the transmission of vibrations without damping from said bezel to said crystal to cause said crystal to resonate under the action of the vibrations transmitted to it by said bezel at said junction zone or zones, and in that said crystal is separated from said bezel at sealing zones, which are different from said junction zones and form a peripheral space for the damped transmission of vibrations and in which said crystal can vibrate in-plane.

According to a preferred embodiment of the invention, for each of said junction zones said upper surface of said crystal rests directly on said notch or on said bezel, and said edge rests directly or indirectly on said notch or on said bezel, and that said lower surface of said crystal rests directly or indirectly on said bezel or on a middle forming part of said timepiece placed next to said bezel to enclose said crystal.

According to a feature of the invention, at each of said junction zones the crystal-bezel unit comprises at least one support block formed by a peripheral spacer block or by a lower block.

According to a feature of the invention, the peripheral space contained between said crystal and said bezel is sealed with sealing means at least outside the surfaces where said crystal and said bezel are joined by said junction zone or zones.

The invention also relates to a striking or musical timepiece comprising at least one such crystal-bezel unit.

BRIEF DESCRIPTION OF THE DRAWINGS

Other features and advantages of the invention will become evident on reading the following description with reference to the attached figures, in which.

DETAILED DESCRIPTION OF PREFERRED EMBODIMENTS

Figure 1:
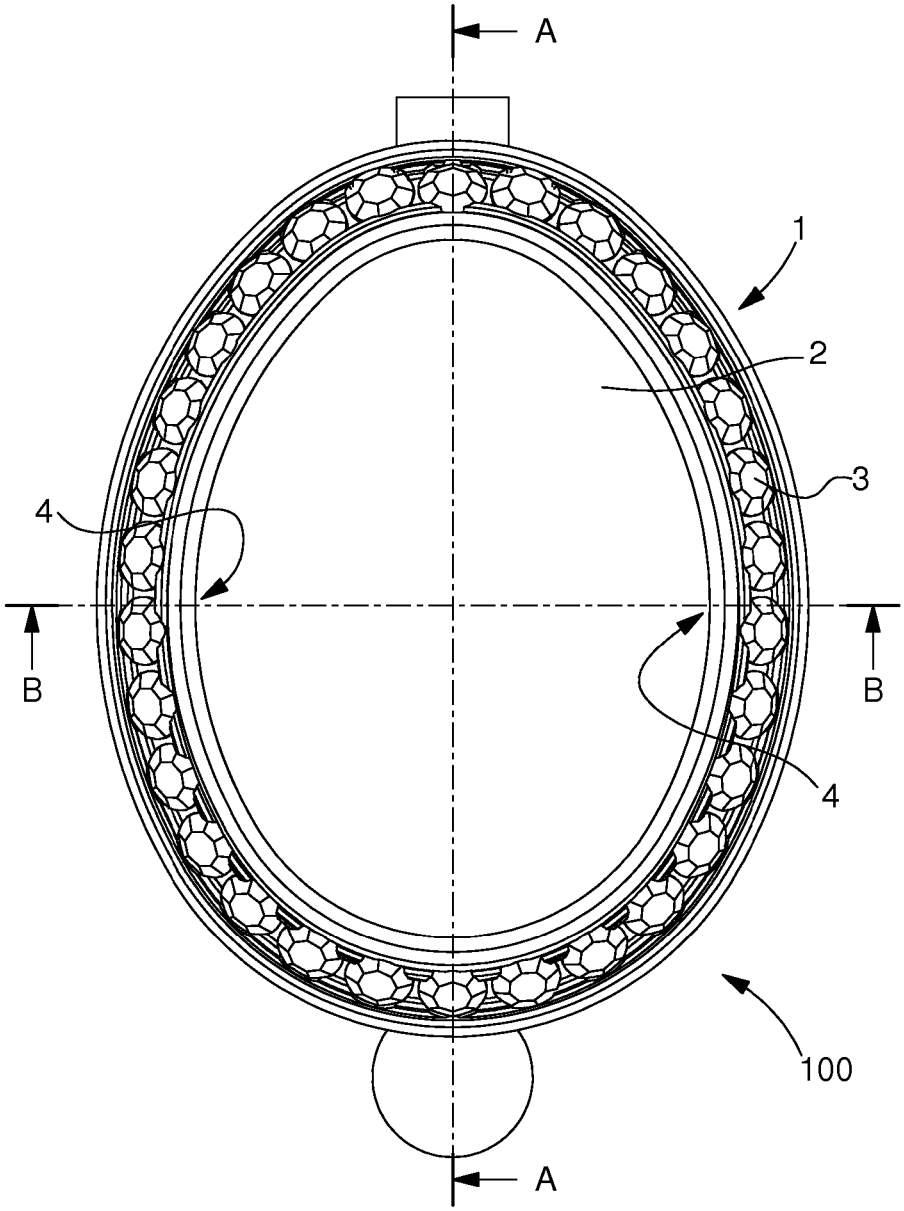
FIG. 1 is a schematic front view of a preferred embodiment of a crystal-bezel unit assembled according to the invention with an upper surface of the crystal visible.
Figure 2:
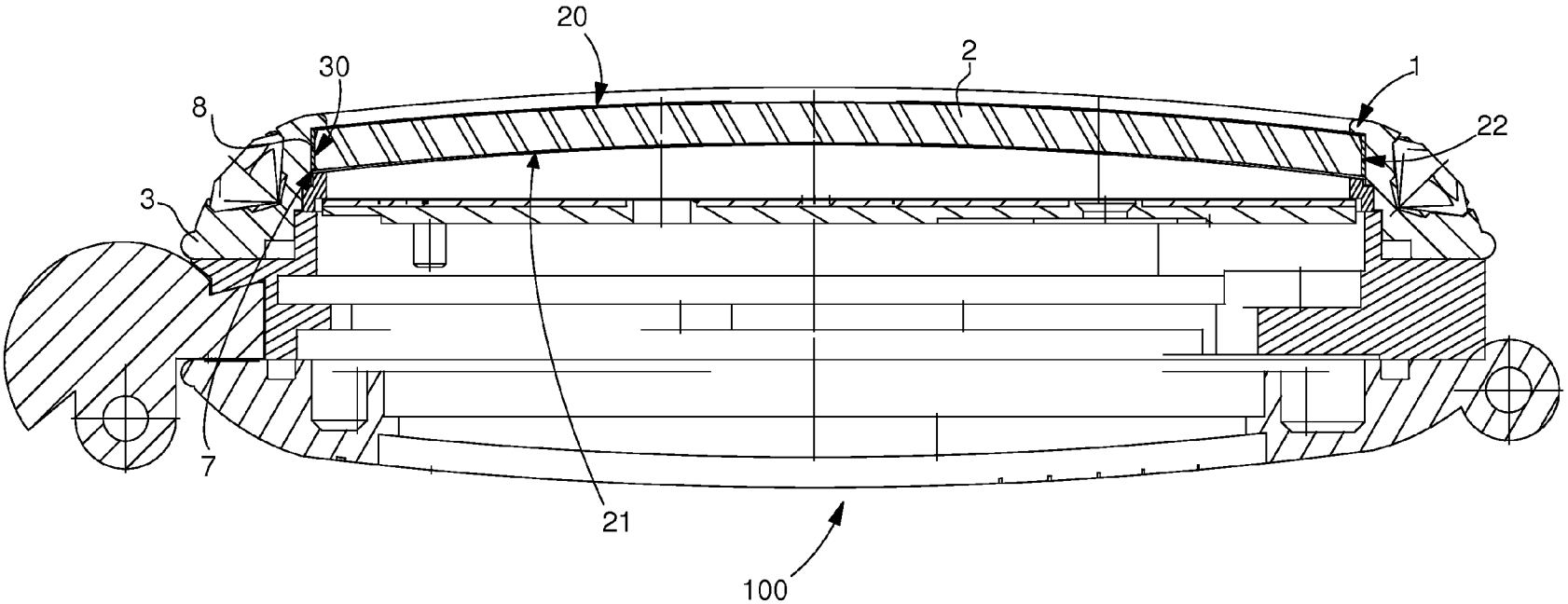
FIG. 2 is a schematic partial cut-away view substantially perpendicular to this upper face of a section taken along plane AA of the crystal-bezel unit of FIG. 1 positioned on a middle of a timepiece.
Figure 3:
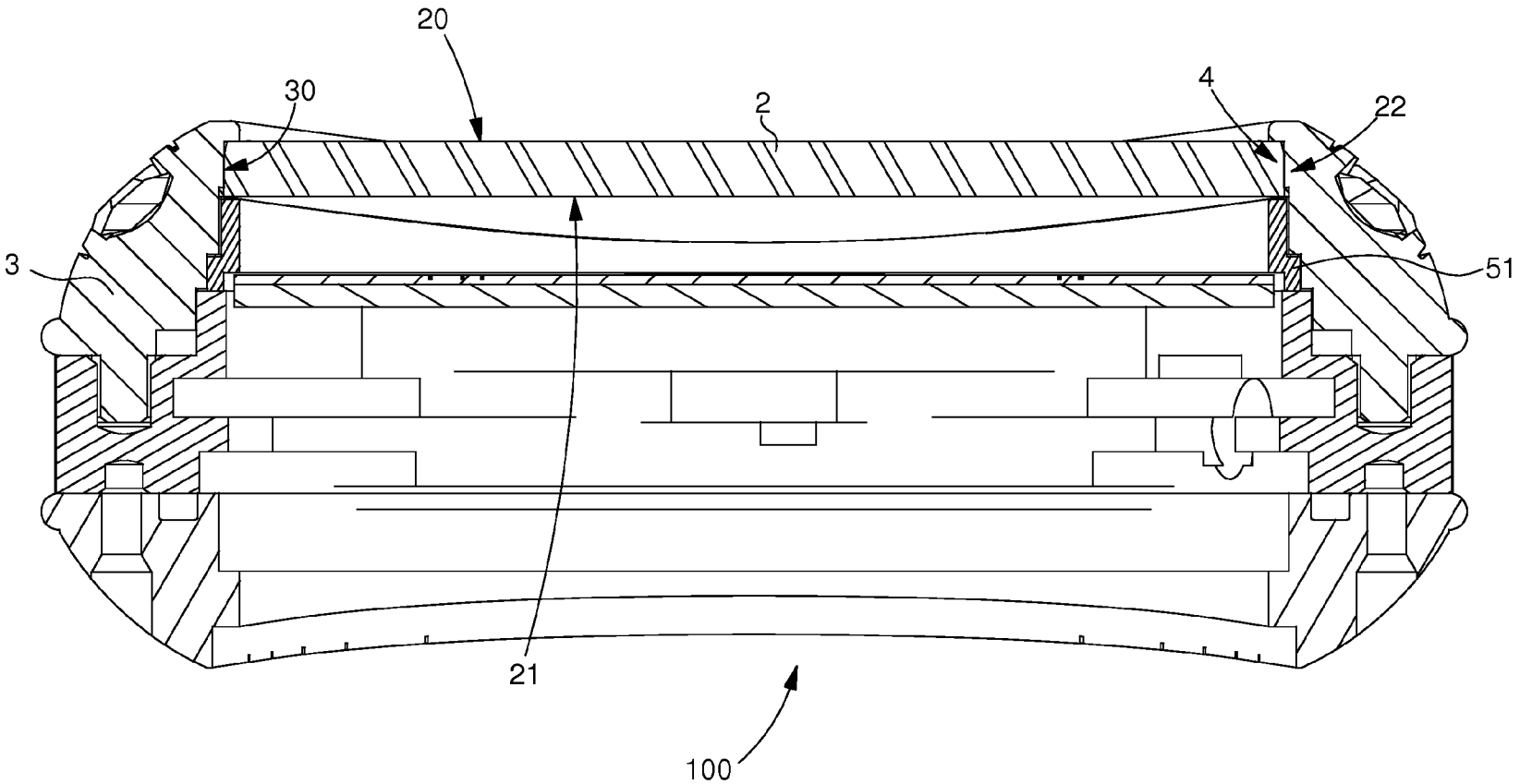
FIG. 3 is a schematic partial cut-away view substantially perpendicular to the upper face and in a plane perpendicular to that of FIG. 2, of a section taken along plane BB of the crystal-bezel unit of FIG. 1, positioned on a middle of a timepiece.

The invention relates to the field of timepieces comprising means for emitting an acoustic signal such as a striking train, musical box or similar. More particularly, it relates to timepieces that can be worn by the user such as watches, pendants and similar.

In traditional acoustic signal timepieces of the striking type or musical box type and in particular in watches, a striker or cam type actuator strikes or causes to vibrate a vibration source such as a bell, a gong or a keypad or similar. The vibration produced by this vibration source is transmitted to elements that can radiate vibration like the middle and the bezel, on condition, however, that there is no insulator or damping element interposed along the path of the vibration. It is very often the case that the vibration cannot be transmitted to the crystal since this is generally insulated with a strip provided to ensure that the watch is sealed and/or is driven into the bezel via a strip made of hard plastic. Because of this, the crystal is not set in vibration and cannot therefore radiate vibration, which explains the limitations of the prior art.

Therefore, the invention endeavors to make usable the large radiation surface that the crystal can provide, which is, moreover, well positioned in relation to the user and the people around him to render the acoustic signal emitted by the striking train or the vibration source audible with a perfect sound quality.

In particular, the invention endeavors to allow vibrations of the crystal not only perpendicular to its surface, as known in the prior art, but above all along the surface in which this crystal extends substantially radially in relation to the normal to the profile of the crystal in its centre.

The invention relates to a process for assembly between a crystal 2, on the one hand, and on the other hand, a bezel 3 for use of this crystal 2 in a timepiece 100 as vibrating element radiating the diffusion of an acoustic signal emitted from a vibration source such as a striking train, musical box or similar and transmitted to said bezel 3.

The invention also relates to a crystal-bezel unit 1, in particular obtained by implementing this process.

The invention endeavors in particular to obtain a high adaptability to every type of timepiece, whatever the positioning of the vibration sources in relation to the crystal. It is essential to be able to transmit these vibrations through the elements forming the structure of the timepiece as far as the bezel, which can be the original bezel or a substitute bezel, wherein this bezel that supports the crystal in turn causes the crystal to vibrate. Where possible it is advantageous to transmit the vibrations via the middle, which forms part of the timepiece and in direct contact with which the bezel is secured, and the following description is just as applicable to a particular crystal-middle as to the preferred embodiment of a crystal-bezel unit.

The innovative principle of the invention is to restrict the fixture of the crystal 2 to the bezel 3, which has a notch 30 to accommodate the crystal 2, to one or more essentially point-like zones referred to hereafter as "junction zones" 4 to allow the largest part of the periphery of the crystal 2 to vibrate freely in a peripheral space 7 between the crystal 2 and the bezel 3 outside these junction zones 4 without impeding this free vibration of the crystal.

The notch 30 allows the crystal 2 to be accommodated and in particular is arranged to allow it to vibrate, and because of this the contact between the crystal 2 and the notch 30 occurs according to the invention at a limited number of points or surfaces. This vibration is desired to be essentially "in-plane", i.e. substantially tangentially to the upper 20 or lower 21 surfaces of the crystal 2, substantially perpendicular to a normal to the crystal 2 in its centre.

As a result, the junction zones 4 are substantially "in-plane", i.e. in the extension of the crystal 2. Naturally, this applies to curved crystals, as illustrated in the figures.

This crystal 2 can thus vibrate over the substantial part of its periphery when the junction zones 4 are reduced in size and separated from one another by other zones, so-called "sealing zones" 40 where the crystal is not rigidly held and can vibrate, i.e. pivot, if the number of junction zones 4 is precisely two.

The crystal 2 behaves, as it were, like a cantilevered beam at one end or also at both ends, if the number of point-like junction zones is one or two respectively. A number of junction zones 4 higher than three is clearly possible and improves the rigidity of the connection between the crystal 2 and the bezel 3, however, the vibration is impeded and the sound output is less spectacular than with one or two junction zones only.

A good simulation of the vibrational behaviour of the whole of the timepiece 100, and more particularly of the crystal-bezel unit 1, in association with a quality configuration, allows the maximum sound efficiency to be obtained.

Figure 13:
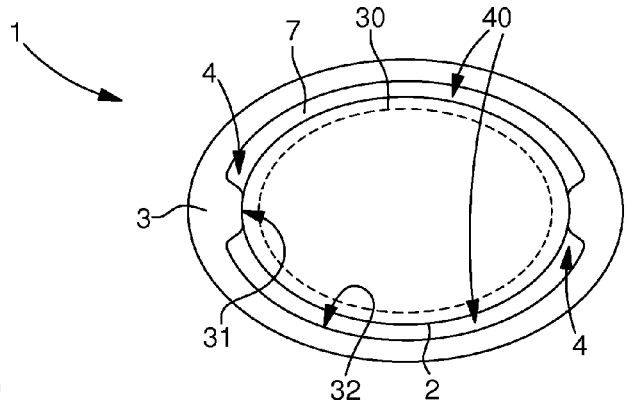
FIG. 13 is a schematic plan view seen of the upper side of an embodiment wherein the bezel has a peripheral cut-out.

On this basis, according to the invention a process for assembly is implemented, according to which the following steps are performed:

- an appropriate number of unconnected junction zones 4 intended to form together the only direct mechanical link for the transmission of vibration from said bezel 3 to said crystal 2, outside which junction zones 4 said crystal 2 has no direct contact with said bezel 3, is determined,
- an alternating sequence is created, of on one hand said junction zones 4 is created to support and rigidly secure the crystal 2, and on other hand sealing zones 40 are created where said crystal 2 has no direct contact with said bezel 3. In a first embodiment corresponding to the figures, and where the crystal 2 has a continuous circumference, an alternating sequence is created, of on one hand junction zones 31 at said bezel 3 to support and rigidly secure said crystal 2 on said bezel 3 and on other hand sealing zones 32 are created where said crystal 2 has no direct contact with said bezel 3, as may be seen in FIG. 13. In a second embodiment that is not shown in the figures, the circumference of the crystal 2 is modified by alternating contact zones and separation zones. In a third embodiment that is not shown in the figures, a succession of contact zones and separation zones is created both on the crystal and on the bezel. If an existing crystal-bezel unit is transformed to improve its sound resonance qualities, the surfaces of direct contact between the crystal 2 and the bezel 3 is restricted by peripheral removal of material from the crystal 2 and/or the bezel 3 in order to create this alternating sequence of junction zones 4 to support and rigidly secure the crystal 2 and sealing zones 40 are created where said crystal 2 has no direct contact with said bezel 3. In a variant at least one support block 5, formed in particular by a peripheral spacer block 50 and/or by a lower block 51, is interposed between the crystal 2 and the bezel 3 to form the junction zone 4. In the case of a new configuration, junction zones 4 are created to support and rigidly secure the crystal 2 and between these junction zones 4 sealing zones 40 are created where the crystal 2 has no direct contact with the bezel 3;

the crystal 2 is secured onto said bezel 3 by supporting and clamping at each junction zone 4 on a junction surface 31 of the bezel 3 in order to transmit to said crystal 2, with the lowest damping possible, every vibration communicated to said bezel 3;

in a peripheral space 7 outside said junction zone or zones 4, said peripheral space 7 formed from a succession of sealing zones 40 alternating with said junction zones 4, said crystal 2 is kept at a distance from said bezel 3 to allow vibrations of said crystal 2 there without impeding them.

The crystal can vibrate in-plane in the sealing zones 40.

When the bezel 3 is integrated into a timepiece 100, it is generally supported on or embedded in a middle 6 forming part of this timepiece 100, and the vibration of the striking mechanism or similar is transmitted to the bezel 3 either directly or through this middle 6.

It is understood that neither the vibrations of the crystal 2 nor the vibrations of the bezel 3 are impeded in the peripheral space 7.

In a first embodiment, each of the sealing zones 40 is delimited by the crystal 2 and by a sealing surface 31.

In order to determine the appropriate number of junction zones 4 it is preferred that:

the natural frequencies of the vibration sources of said acoustic signal such as bells, gongs, keypads or similar are determined, and a pass band corresponding to these natural frequencies is determined;

the peripheral positioning around the crystal 2 is simulated by calculation as a function of the characteristics of the crystal 2 of an appropriate number of such unconnected junction points 4 to adjust the natural vibration frequency and the harmonics of the crystal 2 depending on the thickness of the crystal 2 to make them consistent with the pass band corresponding to the natural frequencies of the vibration sources and to the pass band of the human ear;

the thickness of the crystal 2 and the contact surface between the crystal 2 and the bezel 3 at each junction zone 4 are selected in order to make the natural frequencies and harmonics of the crystal 2 consistent with these pass bands on the basis of the previous calculation and to obtain the appropriate number of junction zones 4 closest to the value two.

It is preferred if the selected appropriate number of junction zones 4 is equal to two, preferably to two only.

In a variant, the thickness of this crystal 2 and the contact surface between this crystal 2 and this bezel 3 at each junction zone 4 are determined in order to make the natural frequencies and harmonics of this crystal 2 consistent with these pass bands on the basis of the previous calculation and to obtain the appropriate number of junction zones 4 closest to the value two.

The formation of the junction zones 4 will be explained in more detail in the description below.

The number, position and surface area of the junction zones 4 and the thickness of the crystal 2 are preferably dimensioned in order to obtain a natural frequency in the range of between 1000 and 7000 Hz, and more particularly between 2000 and 6000 Hz.

In a preferred arrangement of the invention, the appropriate number of junction zones 4 is selected to be at least equal to two, irrespective of which variant of the process is implemented. In particular, this number is selected to be equal to two and the crystal 2 then vibrates substantially in a pivoting manner in relation to an axis joining the two junction zones 4. This possibility of pivoting allows the first natural frequency to be reduced. The two junction zones 4 are preferably diametrically opposed or are as far removed as possible if the crystal 2 is not symmetrical, in order to improve the shock resistance. The two junction zones 4 are preferably disposed either at twelve o'clock and six o'clock or at three o'clock and nine o'clock on a watch, depending on the configuration of the crystal 2. For example, in FIGS. 1, 2, 3 11 and 12 the crystal 2 is substantially a cylinder section centred on a parallel to the three o'clock-nine o'clock axis and this latter axis is selected to position the two junction zones 4 there.

Naturally, if the number of junction zones 4 is enforced during simulation, then it is necessary to act on other parameters, in particular the thickness of the crystal 2 and the contact surface at the junction zone 4. Conversely, if the crystal 2 is only held in place by a single junction zone 4 by simple recessed fitting, e.g. welded at one point, reduction of the first natural frequency will also be obtained, but with a less favourable shock resistance.

To ensure the timepiece 100 is sealed, the peripheral space 7 contained between the crystal 2 and the bezel 3 is sealed with sealing means 8. These sealing means 8 are preferably selected to have at least one flexible sealing strip such as a silicone strip or similar, and/or at least one elastic membrane, in particular a bellows-type membrane or similar, arranged between the bezel 3 and the crystal 2 that does not impede the vibrations of the latter. This bellows arrangement can be a metal bellows or also a bellows made of elastomer or similar. Such an elastic membrane provides a favourable seal and very good shock resistance. It must be selected to be as thin as possible so that it behaves in as neutral a manner as a silicone strip, for example.

In particular, especially when a flexible strip of silicone or similar is selected, the junction zones 4 are also covered with these sealing means 8.

In short, the crystal 2 is surrounded by a succession of different zones, which behave differently in response to the vibrations transmitted to the bezel 3 by the sound or vibration source:

one or more junction zones 4 that together form a mechanical connection for the transmission of vibrations without damping, or at least with minimal damping, from the bezel 3 to the crystal 2 to cause the crystal 2 to resonate under the action of vibrations transmitted to it by the bezel 3 at said junction zone or zones 4;

sealing zones 40, which are different from the junction zones 4 and where the crystal 2 is separated from the bezel 3 and at which the free vibration of the largest portion of the periphery of the crystal 2 is made possible, in the peripheral space 7 around the crystal 2 outside the junction zones 4. In this peripheral space 7, which is delimited by the crystal 2 and the sealing zones 40 that terminate with junction zones 41, the direct transmission of the vibration from the bezel 3 to the crystal 2 is greatly reduced: if the peripheral space 7 is open, only the vibration of the air acts on the crystal 2; in the usual case where the peripheral space 7 is filled with the sealing means 8, such as silicone or similar, to protect the timepiece 100, the vibration of the bezel 3 is transmitted to the crystal 2, but indirectly through this supplementary medium represented by the sealing means 8, and this transmission of the vibration is greatly reduced or highly damped.

The periphery of the crystal 2 on an edge 22 thereof between an upper surface 20 and a lower surface 21 is therefore occupied by an alternating sequence of support and separation surfaces facing the junction zones 4 and the sealing zones 40; the same applies to the bezel 3.

In the junction zones 4 there is a first vibration damping coefficient of vibrations generated in the frequency range of the striking and/or musical mechanism forming part of the timepiece 100, which is as low as possible, since the aim in these junction zones 4 is to transmit the highest amount of vibration energy possible to the crystal 2.

While in the sealing zones 40 there is a second vibration damping coefficient of vibrations generated in the frequency range of the striking and/or musical mechanism forming part of the timepiece 100, which is much higher than said first coefficient, since the aim in these sealing zones 40 is to separate the crystal 2 from the bezel 3 by restricting the exchange of vibration energy between them as far as possible. In a preferred configuration, this second coefficient is that of the sealing means 8 such as a silicone strip that fills the peripheral space 7.

As may be seen in FIGS. 5 to 10, a sealing strip 9 is preferably interposed between the bezel 3, the middle 6 and at least one assembly ring or a lower block 51 interposed between the crystal 2 and the middle 6.

Figure 7:
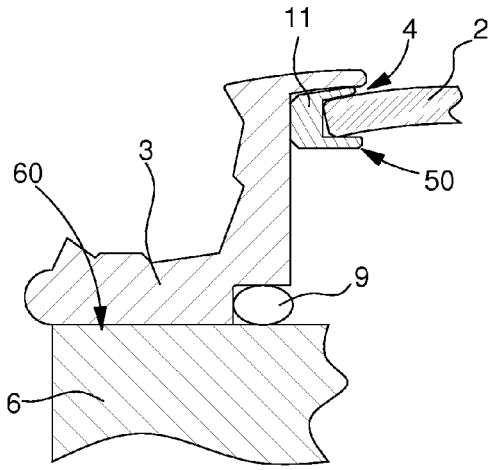
FIG. 7 is a partial schematic view similar to FIG. 2 of a section taken along plane AA of a unit according to another embodiment positioned on a middle of a timepiece.
Figure 10:
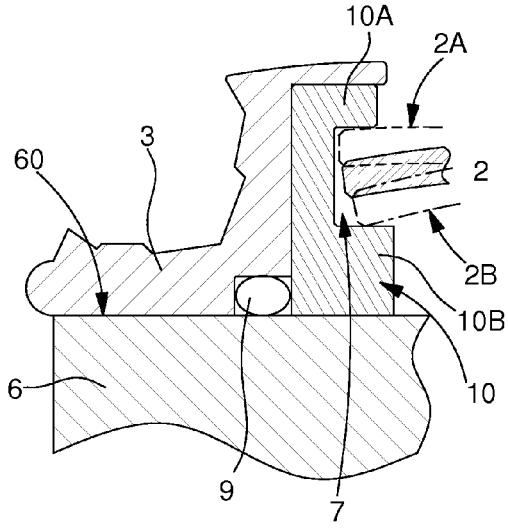
FIG. 10 is a partial schematic view similar to FIG. 3 of a section taken along plane BB of the unit of FIG. 9 positioned on a middle of a timepiece.

Advantageously, and particularly in the case where the emission source of the acoustic signal of the timepiece 100 is likely to cause vibrations of high amplitude at the crystal 2, at least one shock absorber 10 is interposed between the crystal 2, on the one hand, and the notch 30 or also the middle 6 or also an assembly ring resting thereon, on the other hand. This shock absorber 10 is spaced from the crystal 2, in particular spaced from a lower surface 21 and/or an upper surface 20 of this crystal 2 in relation to the equilibrium position of this crystal 2. In a first version, this absorber 10 comprises a single abutment 10B on the side of the lower surface 21, as may be seen in FIG. 12, the upper abutment thus being formed by the bezel notch 30. When the aesthetic appearance and space requirement of the timepiece 100 permits it, this shock absorber 10 preferably has two abutments, one 10A on the side of the upper surface 20 and one 10B on the side of the lower surface 21 of the crystal 2, as may be seen in FIGS. 7 and 10 showing the end positions 2A and 2B of the crystal 2. These abutments are preferably made from a flexible material or are the ends of damping means such as springs or similar. Naturally, the lower surface 10B or both the upper 10A and the lower 10B surfaces, depending on the circumstances, are arranged to limit the movement of the crystal 2 in the case of impact or similar, but also so as not to interfere with its path in its movement of vibration and resonance. The surface or surfaces 10A, 10B is/are therefore above the maximum vibration amplitude of the crystal, calculated in response to the vibrations of the vibration source in the extreme case of vibration amplitude.

It is possible to design the configuration of the junction zones 4 between the crystal 2 and the bezel 3 in different ways: the junction zone or zones 4 is formed either by restricting the direct contact surfaces between the crystal 2 and the bezel 3 by peripheral removal of material from the crystal 2 and/or the bezel 3, or by interposing between the crystal 2 and the bezel 3 at least one support block 5 formed by a peripheral spacer block 50 or by a lower block 51. It is also possible to interpose such support blocks 5 in combination with restricting the contact surfaces between the bezel 3 and the crystal 2. These support blocks 5, peripheral spacer blocks 50 and/or lower support blocks 51 form the mechanical connection for the transmission of vibrations between the crystal 2 and the bezel 3 at these junction zones 4 only, and distance these from one another outside these points. The material of the support blocks must be chosen with care, since it must transmit the vibration from the bezel 3 to the crystal 2 and in particular not damp this vibration. Particularly good results are obtained with metal support blocks 5, the connection to the junction surface 4 is then described as mechanical metal connection for the transmission of vibrations. Support blocks made of ceramic materials or similar or of other hard materials also give good results. These support blocks can also be made of the same material as the crystal 2.

The first way of designing the junction zones 4 thus consists of forming them by localised peripheral clamping. This clamping can be achieved by restricting the surfaces of direct contact between the crystal and the bezel by peripheral removal of material from the crystal and/or the bezel, e.g. by special machining of the bezel 3 at the notch 30 in order to form support surfaces that are separated by recesses, which is preferable to a machining of the crystal 2 because it is less costly.

Clamping can also be achieved in a more economical manner by interposing between the notch 30 and the crystal 2 support blocks 5 formed by peripheral spacer blocks 50. These blocks 50 are referred to thus because they assure both the first function of transmitting vibration from the bezel 3 to the crystal 2 through the contact surface between them to the junction zone 5, and the second function of spacing the rest of the periphery of the crystal 2 in relation to the bezel notch 30. FIG. 7 shows this embodiment where the junction zone 4 is formed by a radial peripheral hold and where the block 50 is more precisely formed by a connection piece 11.

It is clearly evident that the crystal 2 must remain permanently held in the bezel 3 whatever its vibration level, which can be high, for example, during a substantial striking or chime sequence. It is then necessary to provide a crystal 2 that has adequate elastic properties to ensure that it is clamped in the bezel 3 irrespective of its vibration level and that there is an excellent connection to the junction zones 4.

A crystal 2 made of sapphire or mineral glass or an elastic material of suitable characteristics is preferably selected rather than organic glasses that are generally too heterogeneous to guarantee sound purity. Sapphire is preferred for its unscratchable character. It is also possible to use a lead glass, in particular containing more than 21% lead, which has a high elasticity and damps the vibrations to a much lesser extent than mineral glass. The attenuation of the propagation of the sound wave is slower in the case of sapphire or lead glass than with mineral glass, which results in an increased resonance period with these minerals. The dissipation of energy in the form of heat is very low with sapphire, and most of the energy thus remains available for the sound emission. On this basis, an assembly by clamping, in particular in two junction zones, of a sapphire crystal or a crystal made of lead glass in a bezel gives good results with respect to energy and a good sound quality without disrupting the sound and one that is acceptable for the user. The crystal can also be made from a natural mineral material with a sufficient crystallographic structure such as rock crystal, quartz or similar.

The second way of designing the junction zones 4 is to conduct a localised clamping of the crystal 2 in the direction of its thickness in the manner of pincers. In this version, as may be seen in FIG. 11, the periphery of the crystal 2 is spaced from the walls of the notch 30 with only one of the faces of the crystal 2, for instance its upper surface 20, coming into contact at least at points at the junction zone 4 with a surface of this notch 30. The lower surface 21 of the crystal 2 is immobilised at each junction zone 4 by a support block 5. This support block 5 can be made either in the form of a lower block 51 resting on the bezel 3 or on the middle 6, or in the form of a projection of an intermediate piece. This lower block 51 or this intermediate piece is advantageously substantially annular in shape similar to that of the bezel. Such an intermediate piece is also supported, directly or indirectly, on the middle 6 and is seated in the bezel 3, either in the block 30 or in a seating provided for this purpose. The crystal 2 is thus clamped at points between the notch 30, on the one hand, and this lower block 51 or this intermediate piece, on the other.

Figure 4:
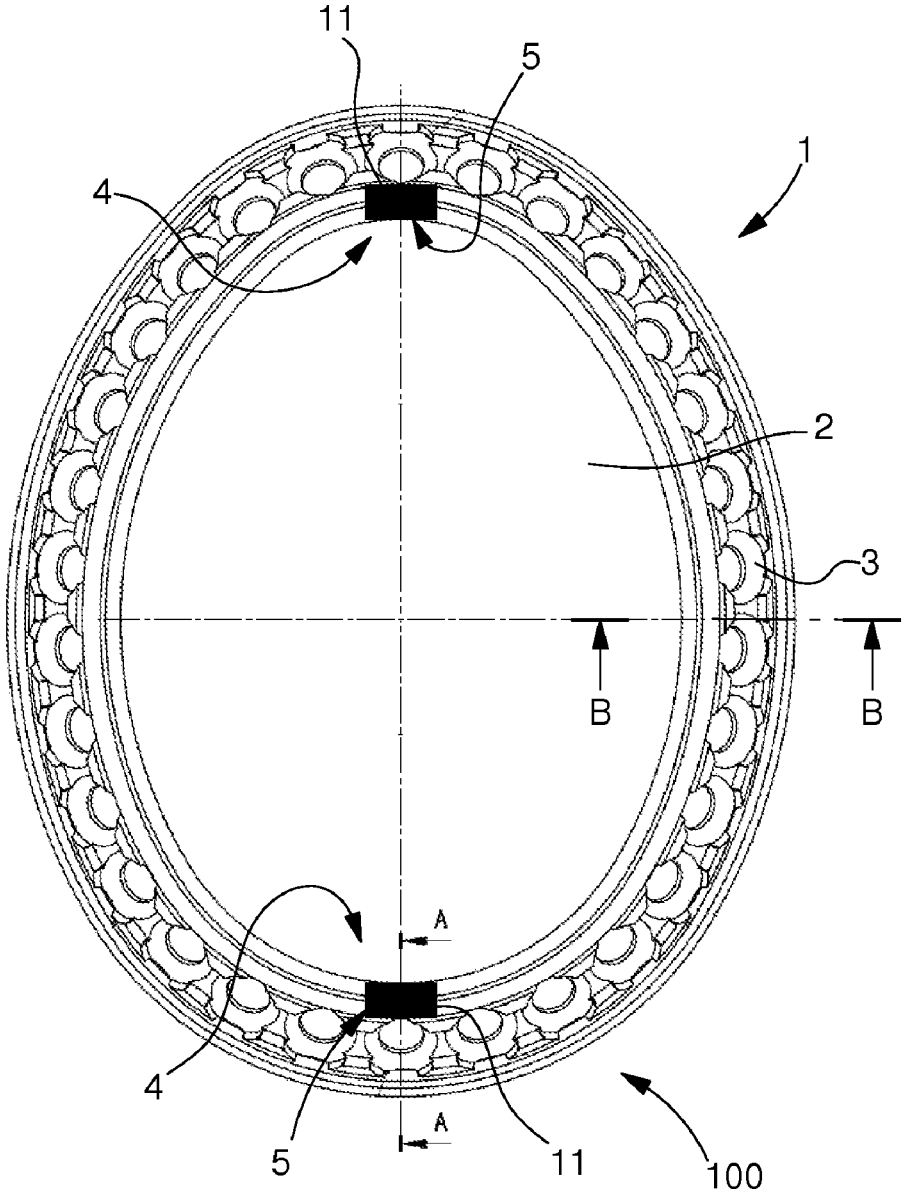
FIG. 4 is a view similar to FIG. 1 of another crystal-bezel unit assembled according to another embodiment of the invention.
Figure 5:
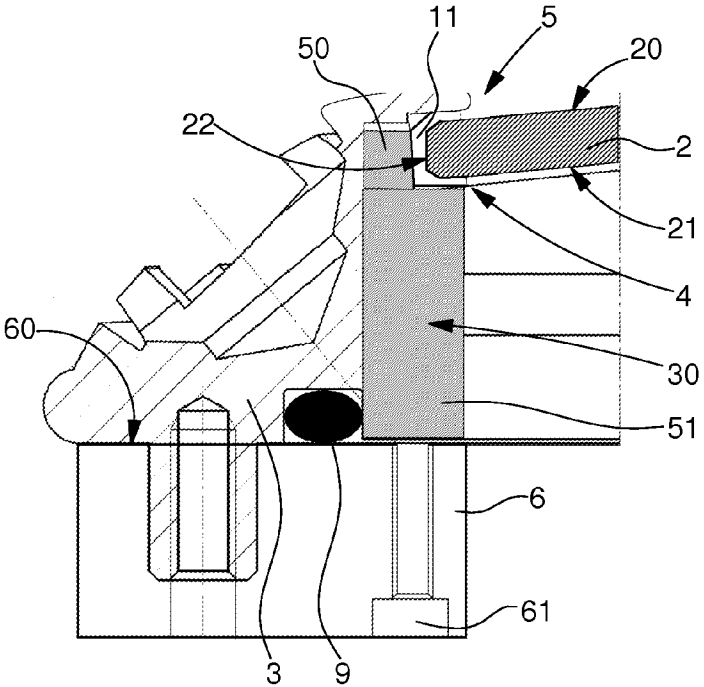
FIG. 5 is a partial schematic view similar to FIG. 2 of a section taken along plane AA of the unit of FIG. 4 positioned on a middle of a timepiece.

In a variant of a practical example of the invention, as may be seen in FIGS. 4, 5 and 7, at least one such junction zone 4 is formed by lining the periphery of the crystal 2 with a connection piece 11, the inside profile of which is supported on the crystal both on the upper surface 20 of the crystal 2 and on the lower surface 21 of the crystal 2 and/or on an edge 22 connecting the lower surface 21 and the support surface 20 of the crystal 2.

In a variant, to secure the crystal 2 to the bezel 3 this crystal 2 thus fitted with a connection piece 11 is positioned in the notch 30 so that this crystal 2 is spaced from this bezel 3 at every point other than these junction zones 4 and so that for each of these junction zones 4 at least this upper surface 20 or this edge 22 is supported directly or indirectly on this notch 30 and that for each of these junction zones 4 this lower surface 21 is supported directly or indirectly on this bezel 3 or on the middle 6 arranged next to this bezel to enclose this crystal 2.

Figure 6:
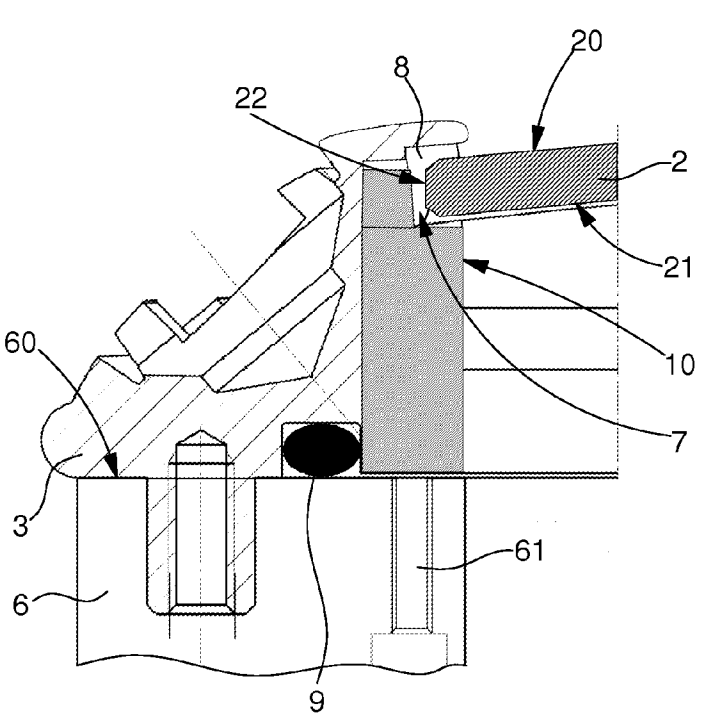
FIG. 6 is a partial schematic view similar to FIG. 3 of a section taken along plane BB of the unit of FIG. 4 positioned on a middle of a timepiece.

In a particular embodiment, as may be seen from the example of FIGS. 5 and 6, at least one intermediate assembly ring is interposed between the crystal 2, on the one hand, and the bezel 3 and/or the middle 6, on the other.

These figures show the example of two superposed assembly rings, one 50 radially of the crystal 2 between the surroundings of the edge 22, on the one hand, and the wall of the notch 30, on the other, and the other 51 arranged between the vicinity of the lower surface 21 of the crystal 2, on the one hand, and a surface 60 of the middle 6, on the other.

Figure 14:
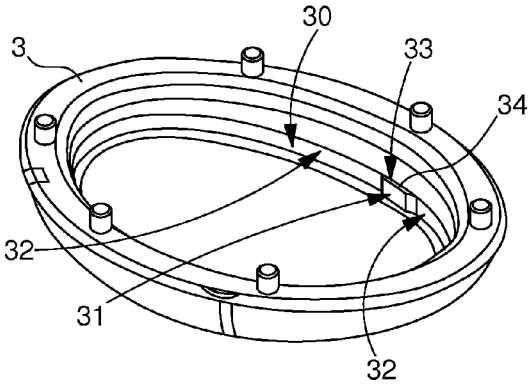
FIG. 14 is a schematic perspective view of a bezel comprising two contact surfaces to define two contact zones according to the invention.
Figure 15:
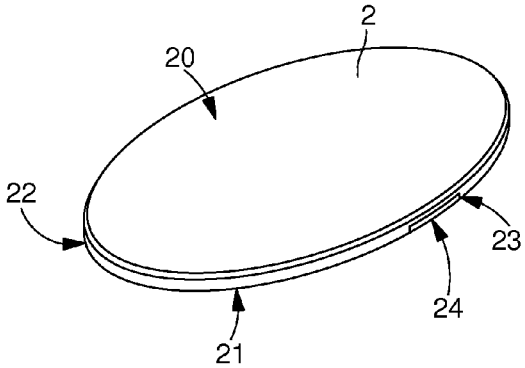
FIG. 15 is a schematic perspective view of a crystal arranged to cooperate with the bezel of FIG. 14 and comprising two complementary contact surfaces to define two contact zones according to the invention.
Figure 16:
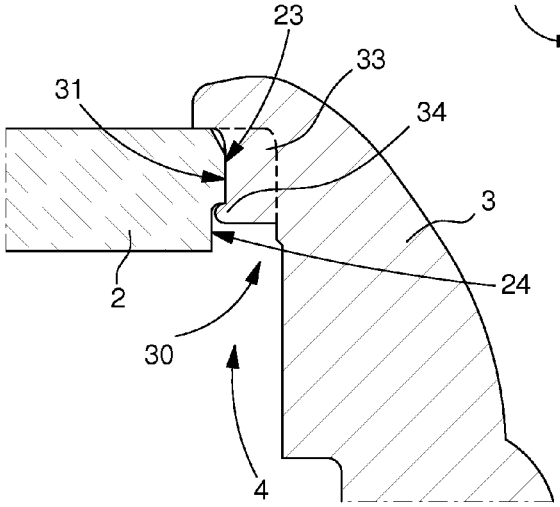
FIG. 16 is a schematic view in partial section taken along a plane passing through these two contact zones of the unit formed by the bezel of FIG. 14 and the crystal of FIG. 15.

A particular variant is shown in FIGS. 14 to 16. A bezel 3 comprises projections 33, in particular two projections 33, of which only one is visible in FIG. 14, projecting radially towards the centre of an opening intended to receive the crystal 2. Each projection 33 comprises a support surface 31 to receive a complementary support surface 23 belonging to the crystal 2 and to form a junction zone 4 with this. This support surface 31 is surrounded by undercut sealing surfaces 32 intended to receive a sealing means 8 and dimensioned in such a manner as to allow free vibrations of the crystal 2. Each projection 33 comprises a lug 34, which is arranged to cooperate with a notch 24, by clipping, clamping or similar therein, or a flat surface forming part of the crystal 2 of FIG. 15, which is separated from an upper surface 20 of the crystal 2 by the complementary support surface 23.

In the case of a crystal 2 made of sapphire to fit a wristwatch of usual size with a bezel 3 made of gold, the support at the junction zone 4 is preferably achieved by a very gentle clamping in the range of between 0 and 60 micrometers at the diameter.

Figure 8:
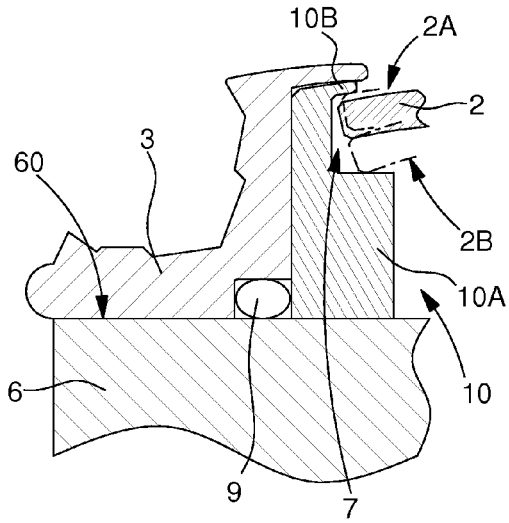
FIG. 8 is a partial schematic view similar to FIG. 3 of a section taken along plane BB of the unit of FIG. 7 positioned on a middle of a timepiece.
Figure 9:
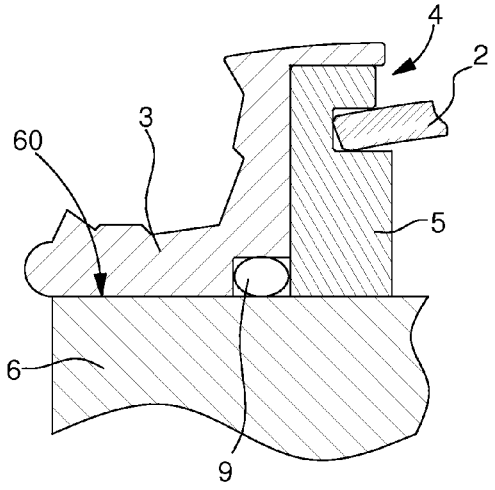
FIG. 9 is a schematic view in partial section similar to FIG. 2 of a section taken along plane AA of a unit according to a further embodiment positioned on a middle of a timepiece.
Figure 12:
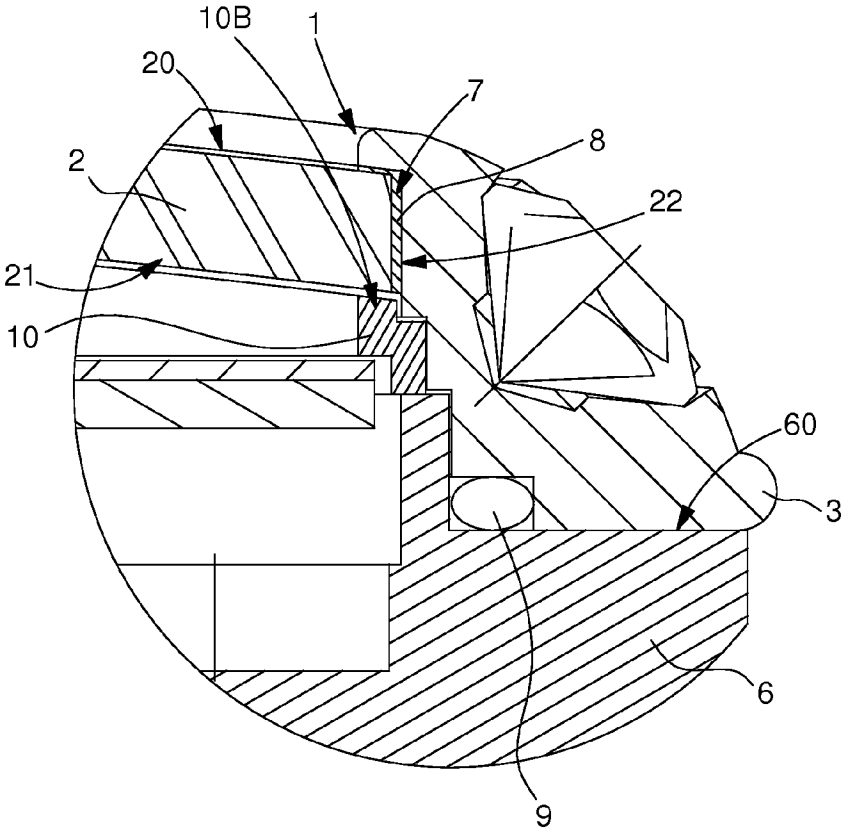
FIG. 12 is a partial schematic view of a detail of a section like in FIG. 2.
Figure 11:
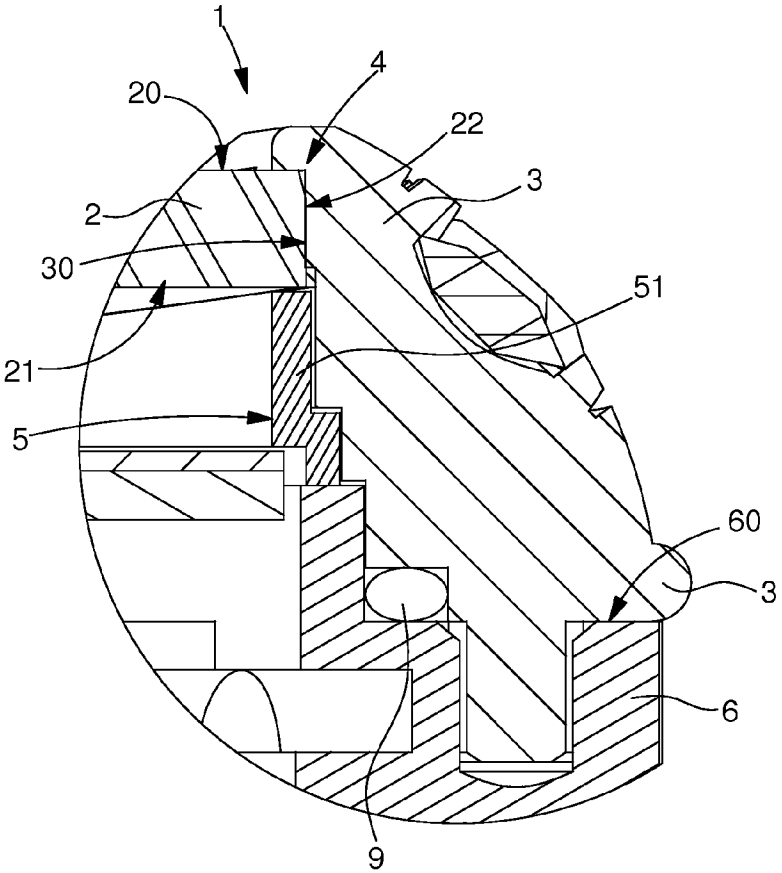
FIG. 11 is a partial schematic view of a detail of a section like in FIG. 3.

Whichever way the junction zones 4 are formed, the periphery of the crystal 2 outside the junction zones 4 is thus free to vibrate in a peripheral space 7, in the sealing zones 40 where the crystal 2 is not in contact with either the bezel 3 or with the middle 6, as may be seen in FIGS. 8, 10 and 12.

It is understood that it is also possible to freely form junction zones 4 that are differentiated and mixed, some in the first way, the others in the second way, on the same timepiece 100 or on the same crystal-bezel unit 1. Moreover, these embodiments of the junction zones 4 are not restrictive in any way. For example, FIG. 5 shows a junction zone 4 having both a radial peripheral hold of the crystal 2 in the bezel 3 by a connection piece 11 clamping the crystal 2 that is supported in the notch 30 by means of a peripheral spacer block 50, as well as a hold in the direction of the thickness of the crystal that is assured here by a lower block 51 supported on the middle 6. Such an assembly means that the elements that enable the clamping to be achieved, e.g. the peripheral block 50 and the lower block 51, can be made from elastic materials that allow assembly by compression, on condition, however, that the favourable transmission of vibration from the bezel 3 to the crystal 2 is assured without any damping action because of the blocks. Advantageously, at least one adjusting screw 61 at the middle 6 allows the stress on the lower block 51 and therefore on the crystal 2 to be adjusted.

A junction zone 4 can be formed by arranging two junction points or more side by side spaced at some millimeters from one another. It is important that the distance between these junction zones is as large as possible. However, within the same junction zone it is preferable to limit the spacing between the end points forming the connection, typically those embedding the crystal 2, since the greater this spacing and the higher the natural frequency of the assembly, the less significant the benefit is. In the case of a timepiece such as a watch, the maximum spacing within the same junction zone must be in the range of between a few tenths of a millimeter and some millimeters, 5 for example.

In a variant, the junction zone can also be formed by securing the crystal 2 to the bezel 3 by a mechanical fixture, e.g. by screw connection, or by welding or soldering between the bezel 3 and a deposit of metal on the crystal 2 conducted by means of a chemical vapour deposition process or cathodic sputtering or similar.

The invention also relates to a crystal-bezel assembly unit 1 for a timepiece 100 that is arranged for use of a crystal 2 as vibrating element radiating the diffusion of an acoustic signal emitted from a vibration source such as a striking train, musical box or similar. This crystal-bezel unit 1 comprises a bezel 3, on the one hand, that comprises a notch 30 for accommodating a crystal 2 and, on the other hand, such a crystal 2 comprising an upper surface 20 and a lower surface 21 connected by an edge 22.

According to the invention, this crystal-bezel unit 1 comprises one or more junction zones 4 that together form a mechanical connection for the transmission of vibrations from the bezel 3 to the crystal 2 to cause this crystal 2 to resonate under the action of vibrations transmitted to it by this bezel 3 at this or these junction zone or zones 4 respectively. The crystal 2 is spaced from the bezel 3 in the sealing zones 40 outside the surfaces where they are joined respectively by this or these junction zone or zones 4. The crystal 2 can vibrate in-plane in these sealing zones 40.

In each of these junction zones 4 the upper surface 20 or the edge 22 of the crystal 2 rests directly on the notch 30. In each of the junction zones 4 the lower surface 21 of the crystal rests directly or indirectly on the bezel 3 or on the middle 6.

In a particular embodiment, in each of the junction zones 4 the upper surface 20 of the crystal 2 rests directly on the notch 30 and the edge 22 of the crystal 2 rests directly or indirectly on the notch 30 or on the bezel 3, and the lower surface 21 of the crystal 2 rests directly or indirectly on either the bezel 3 or on the middle 6.

At least one junction zone 4, and preferably at each junction zone 4, the crystal-bezel unit 1 advantageously comprises at least one support block 5. This support block 5 is formed by a peripheral spacer block 50 or by a lower block 51, as described above.

It is preferred if such a peripheral block 50 is mounted under stress between the crystal 2 and the bezel 3 to hold the crystal 2 and preferably has a substantially U-shaped profile and is fitted to rest on the crystal 2 with its inside profile and on the bezel 3 with its outside profile. The crystal 2 fitted with this block 50 is seated in the notch 30 without direct contact with the bezel 3 other than that provided at each junction zone 4.

In the variants of FIGS. 4 to 10, the crystal-bezel unit 1 thus comprises at least one such support block 5 formed by a connection piece 11 located at the junction zone 4 or preferably a group of unconnected connection pieces 11 located at all the junction zones 4. The crystal 2 rests on the bezel 3 at the junction zone 4 by means of at least one such connection piece 11. This connection piece 11 preferably has a substantially U-shaped profile and is fitted to rest on the crystal 2 with its inside profile, preferably both on the edge 22 and on the upper 20 and lower 21 surfaces of the crystal 2, and with its outside profile on the bezel 3 close to the upper surface 20 of the crystal supported directly or indirectly on the notch 30 to cause the crystal to resonate with the bezel 3. The crystal 2 fitted with this block 50 is seated in the notch 30. The crystal 2 is spaced from the bezel 3 outside the surfaces where they are joined respectively by a junction zone 4. Preferably, in the case of each connecting piece 11 at least one of the surfaces of its outside profile close to the upper surface 20 of the crystal rests directly or indirectly on the notch 30 and another of the surfaces of its outside profile close to the lower surface 21 of the crystal rests directly or indirectly on the bezel 3 or on the middle 6.

A contact between the connection piece 11, or more generally the support block 5, and the middle 6 is advantageous, because it allows vibrations to be transmitted to the crystal 2 both by the bezel 3 and by the middle 6. Advantageously, in a timepiece 100 this middle 6 is in vibratory contact with a membrane that is itself in vibratory contact with the vibration source or sources. The middle 6 can also support the vibration source or sources directly by a vibratory contact.

In a particular embodiment, the crystal-bezel unit 1 comprises at least one intermediate assembly ring interposed between the junction zone or zones 4, on the one hand, and the bezel 3 and/or the middle 6, on the other. In the embodiment of FIGS. 5 and 6, at least one intermediate assembly ring 51 is interposed between the connection pieces 11, on the one hand, and the bezel 3 and/or the middle 6, on the other. This assembly ring 51 preferably allows a stress to be created that is adjustable by screw 61, for example, as may be seen in FIGS. 5 and 6.

The peripheral space 7 contained between the crystal 2 and the bezel 3, at least outside the surfaces where the crystal 2 and the bezel 3 are joined by this or these junction zone or zones 4, is sealed at the sealing zones 40 with sealing means 8, as described above.

A flexible sealing strip such as a silicone strip or similar is preferably selected and the junction zones 4 can also be covered with this strip forming these sealing means 8.

In an advantageous embodiment, as may be seen in the figures, in addition to these sealing means 8 that relate to the periphery of the crystal 2, the crystal-bezel unit 1 comprises at least one sealing strip 9, as described above, for sealing at the joining plane 60 or the joining surface between the bezel 3 and the middle 6 of the timepiece 100.

Interposed between the crystal 2, on the one hand, and the notch 30 or the middle 6 or an assembly ring resting on this, on the other, the crystal-bezel unit 1 preferably comprises at least one shock absorber 10, as described above, spaced from the crystal 2 in relation to the equilibrium position thereof.

In a variant the crystal-bezel unit 1 also comprises elastic restoring means that allow the crystal 2 to be repositioned in the case of stress.

In an advantageous embodiment, the crystal is made from sapphire. In a first embodiment, it is made from mineral glass. In a second variant, it is made from lead glass.

The crystal-bezel unit 1 according to the invention preferably comprises two junction zones 4 that allow both a very good mechanical strength and a high vibration amplitude of the crystal 2.

In the case of a watch, the clamping value is preferably in the range of between 0.010 and 0.060 millimeters at the radius, and preferably between 0.010 and 0.030 millimeters. This clamping is a radial clamping over the periphery of the crystal. Axial clamping is possible in the axial direction, i.e. in the direction of the thickness of the crystal, but it is understood that if such an axial clamping is too pronounced, it will impede the vibration and radiation from the crystal in this direction and it is also preferable to limit this to a simple hold of the crystal, in particular by lower blocks 51.

In relation to a traditional timepiece in which the crystal can only vibrate weakly, the acoustic output obtained by implementing the invention is significant: in the order of 20 dBA.

The invention also relates to a timepiece 100 having at least one such crystal-bezel unit 1. It comprises a middle 6 having a joining plane 60 arranged to cooperate with the bezel 3 to form a seal.

In short, the invention provides the advantage of causing both the crystal and the bezel to participate in the vibration and sound radiation.

It is possible to match the natural frequency of the assembly by adapting the dimensioning of the connection surfaces at the junction zones 4, or connection pieces 11 if they are used, as well as the thickness of the crystal 2.

Naturally, the invention can also be applied to a direct assembly of the crystal 2 in the middle 6, however, assembly of the crystal 2 in the bezel 3 according to the invention specifically allows assembly to occur irrespective of the timepiece 100, and the invention can be implemented easily for any timepiece by replacing the original bezel and/or crystal with a crystal-bezel unit 1 according to the invention, or even by adapting the original parts by machining and/or interposing adequate support blocks, as described above.

It is understood that the invention endeavors to transmit vibrations from the sound source to the crystal to cause this to resonate. Depending on the circumstances, the vibration chain transmits the vibration from the vibration source, striking train, bell, gong, chimes, musical box, vibrator or the like from the bottom plate of the timepiece to the middle of the timepiece, from the middle to the bezel and from the bezel to the crystal.

Naturally, other vibration link chains can be achieved by implementing the invention, in particular such as vibration source/middle/bezel/crystal or also vibration source/bezel/crystal.

What is claimed is:

1. A method for assembly between a crystal and a bezel, wherein the bezel has a notch for accommodating the crystal, for use of the crystal in a striking or musical timepiece as a vibrating element radiating a diffusion of an acoustic signal emitted from a vibration source, or a striking train, or a musical box, or an alarm clock, and transmitted to the bezel, wherein the method comprises the steps of:

(a) determining an appropriate number of unconnected junction zones intended to form together the only direct mechanical link for the transmission of vibration from the bezel to the crystal, wherein the crystal has no direct contact with the bezel outside the junction zones;

(b) creating an alternating sequence of the junction zones created to support and rigidly secure the crystal in direct contact with the bezel, and a plurality of sealing zones where the crystal has no direct contact with the bezel and can vibrate in-plane;

(c) securing the crystal onto the bezel by supporting and clamping at each junction zone on a junction surface of the bezel in order to transmit every vibration communicated to the bezel to the crystal; and (d) forming a peripheral space outside the junction zone or zones, wherein the peripheral space is formed from a succession of sealing zones alternating with the junction zones, wherein each of the sealing zones is delimited by the crystal and one sealing surface, and wherein the crystal is kept at a distance from the bezel to allow vibrations of the crystal without impedance.

2. The method for assembly according to claim 1, wherein, in order to determine the appropriate number of the junction zones, the method having additional steps comprising:

(a)(1) determining the natural frequencies of the vibration sources of the acoustic signal, or bells, gongs or keypads are determined, and a pass band corresponding to the natural frequencies;

(a)(2) simulating the peripheral positioning around the crystal by calculation as a function of the characteristics of the crystal of an appropriate number of the unconnected junction points to adjust the natural vibration frequency and the harmonics of the crystal depending on the thickness of the crystal to make them consistent with the pass band corresponding to the natural frequencies of the vibration sources and to the pass band of the human ear; and (a)(3) selecting the thickness of the crystal and the contact surface between the crystal and the bezel at the junction zone in order to make the natural frequencies and harmonics of the crystal consistent with the pass bands on the basis of the previous calculation and to obtain the appropriate number of junction zones closest to the value two.

3. The method for assembly according to claim 1, wherein the appropriate number of the junction zones selected is equal to two.

4. The method for assembly according to claim 1, wherein at least one junction zone is obtained by lining the periphery of the crystal with a connection piece, the inside profile of which rests against the crystal both on an upper surface of the crystal, on the one hand, and on an edge and/or on an inside surface of the crystal on the other hand.

5. The method for assembly according to claim 1, wherein the space contained between the crystal and the bezel is sealed with sealing means comprising at least one flexible sealing strip and/or at least one elastic membrane.

6. The method for assembly according to claim 1, wherein at least one shock absorber spaced from the crystal in relation to the equilibrium position thereof is interposed between the crystal, on the one hand, and the bezel notch, on the other hand, or also a middle forming part of the timepiece placed next to the bezel.

7. A crystal-bezel assembly unit for a striking or musical timepiece having at least one vibration source or a striking train, or a musical box, or an alarm clock configured for use of a crystal as vibrating element radiating the diffusion of an acoustic signal emitted from the vibration source, wherein the crystal-bezel unit comprises:

(a) a bezel that transmits the vibrations emitted from the vibration source, wherein the bezel has a notch for accommodating a crystal; and (b) a crystal comprising an upper surface and a lower surface connected by an edge, wherein the crystal includes one or more junction zones between the bezel and the crystal that together form a mechanical connection for the transmission of vibrations without damping from the bezel to the crystal to cause the crystal to resonate under the action of vibrations transmitted to it by the bezel at the junction zone or zones, and wherein the crystal is separated from the bezel at sealing zones, which are different from the junction zones and form a peripheral space for the damped transmission of vibrations and where the crystal can vibrate in-plane.

8. The crystal-bezel unit according to claim 7, wherein for each of the junction zones, the upper surface of the crystal rests directly on the notch or on the bezel, and the edge rests directly or indirectly on the notch or the bezel, and that the lower surface of the crystal rests directly or indirectly on the bezel or on a middle forming part of the timepiece placed next to the bezel to enclose the crystal.

9. The crystal-bezel unit according to claim 7, wherein at each of the junction zones it comprises at least one support block formed by a peripheral spacer block or by a lower block.

10. The crystal-bezel unit according to claim 9, wherein the peripheral block is mounted under stress between the crystal and the bezel to hold the crystal and is configured to rest on the crystal with its inside profile and on the bezel with its outside profile, wherein the crystal fitted with the block is seated in the notch without direct contact with the bezel other than that provided at the junction zone.

11. The crystal-bezel unit according to claim 7, wherein it comprises a bezel having two projections, which project radially towards the centre of an opening intended to receive the crystal and each of which has a support surface to receive a complementary support surface of the crystal and to form with it one of the junction zones, wherein the support surface is surrounded by undercut sealing surfaces intended to receive a sealing means and dimensioned so as to allow free vibrations of the crystal, wherein each projection comprises a lug, which is arranged to cooperate with a notch, by clipping or clamping therein, or a flat surface of the crystal, which is separated from an upper surface of the crystal by the complementary support surface.

12. The crystal-bezel unit according to claim 7, wherein outside the surfaces where the crystal and the bezel are joined by the junction zone or zones, the peripheral space contained between the crystal and the bezel is sealed with the sealing means comprising at least one flexible sealing strip and/or at least one elastic membrane.

13. The crystal-bezel unit according to claim 7, wherein interposed between the crystal, on the one hand, and the bezel notch, on the other hand, or a middle forming part of the timepiece placed next to the bezel, it comprises at least one shock absorber spaced from the crystal in relation to the equilibrium position thereof.

14. The crystal-bezel unit according to claim 7, wherein it comprises two junction zones and only two.

15. A striking or musical timepiece comprising at least one vibration source, or a striking train, or a musical box, or an alarm clock, comprising at least one crystal-bezel unit according to claim 7, wherein it comprises a middle transmitting the vibrations of the vibration source to the bezel.

* * * * *